US012410936B2

(12) United States Patent
Shimokawa et al.

(10) Patent No.: US 12,410,936 B2
(45) Date of Patent: Sep. 9, 2025

(54) INDOOR-TEMPERATURE ESTIMATION APPARATUS, NON-TRANSITORY COMPUTER-READABLE MEDIUM, AND INDOOR-TEMPERATURE ESTIMATION METHOD

(71) Applicant: Mitsubishi Electric Corporation, Tokyo (JP)

(72) Inventors: Takeaki Shimokawa, Tokyo (JP); Aki Kimura, Tokyo (JP); Shogo Namatame, Tokyo (JP); Hirotoshi Yano, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 447 days.

(21) Appl. No.: 17/917,255

(22) PCT Filed: May 18, 2020

(86) PCT No.: PCT/JP2020/019590
§ 371 (c)(1),
(2) Date: Oct. 6, 2022

(87) PCT Pub. No.: WO2021/234763
PCT Pub. Date: Nov. 25, 2021

(65) Prior Publication Data

US 2023/0123181 A1 Apr. 20, 2023

(51) Int. Cl.
*F24F 11/64* (2018.01)
*F24F 110/10* (2018.01)

(52) U.S. Cl.
CPC ..... *F24F 11/64* (2018.01); *F24F 2110/10* (2018.01)

(58) Field of Classification Search
CPC .. F24F 11/30; F24F 11/63; F24F 11/89; F24F 11/64; F24F 11/46; F24F 11/47; F24F 11/62; F24F 2110/10
See application file for complete search history.

(56) References Cited

U.S. PATENT DOCUMENTS 11,920,807 B2 * 3/2024 Song ..... F24F 11/64
2015/0300892 A1 * 10/2015 Malhotra ..... H04L 12/2807 702/130

(Continued)

FOREIGN PATENT DOCUMENTS

CN 114992814 A * 9/2022 ..... F24F 11/64
JP 2013-167425 A 8/2013

(Continued)

OTHER PUBLICATIONS

Afroz, Z., Shafiullah, G.M., Urmee, T. and Higgins, G., 2018. Modeling techniques used in building HVAC control systems: A review. Renewable and sustainable energy reviews, 83, pp. 64-84. (Year: 2018).*

(Continued)

*Primary Examiner* — Alicia M. Choi
(74) *Attorney, Agent, or Firm* — XSENSUS LLP

(57) ABSTRACT

An effect determining unit to specify a learning affected period during which room temperature is affected by a temperature controller and a learning unaffected period during which the room temperature is not affected by the temperature controller; a room-temperature-model generating unit configured to learn a state of an outdoor and room temperature in a learning unaffected period to generate a room temperature model indicating the relationship between the state and the room temperature; an unaffected-room-temperature estimating unit configured to estimate learning temporary room temperature, which is the room temperature presumed to be unaffected by the temperature controller, in (Continued)

the learning affected period by using a room temperature model; and a room-temperature-change-model generating unit configured to learn the room temperature and learning temporary room temperature in the learning affected period, to generate a room temperature change model indicating the change in the room temperature caused by the temperature controller.

16 Claims, 10 Drawing Sheets

(56) References Cited

U.S. PATENT DOCUMENTS

| | | | | |
|---|---|---|---|---|
| 2018/0181149 | A1* | 6/2018 | Matsuoka | G05B 15/02 |
| 2018/0195748 | A1* | 7/2018 | Sinha | F24F 11/62 |
| 2018/0195752 | A1* | 7/2018 | Sasaki | F24F 11/64 |
| 2020/0400334 | A1 | 12/2020 | Ariga | |
| 2021/0262682 | A1* | 8/2021 | Nabi | G05B 19/042 |

FOREIGN PATENT DOCUMENTS

| | | | |
|---|---|---|---|
| JP | 2013-204985 | A | 10/2013 |
| JP | 2017-67427 | A | 4/2017 |
| JP | 2018-91560 | A | 6/2018 |
| WO | 2018/025427 | A1 | 2/2018 |

OTHER PUBLICATIONS

Office Action issued Jun. 27, 2023 in counterpart Japanese Patent Application No. 2022-523746 with machine English translation thereof, 6 pages.

International Search Report and Written Opinion mailed on Aug. 11, 2020, received for PCT Application PCT/JP2020/019590, filed on May 18, 2020, 9 pages including English Translation.

Office Action issued Dec. 12, 2023 in Japanese Patent Application No. 2022-523746, 6 pages.

* cited by examiner

INDOOR-TEMPERATURE ESTIMATION APPARATUS, NON-TRANSITORY COMPUTER-READABLE MEDIUM, AND INDOOR-TEMPERATURE ESTIMATION METHOD

CROSS-REFERENCE TO RELATED APPLICATION

The present application is based on PCT filing PCT/JP2020/019590, filed May 18, 2020, the entire contents of which are incorporated herein by reference.

TECHNICAL FIELD

The disclosure relates to an indoor-temperature estimation apparatus, non-transitory computer-readable medium, and an indoor-temperature estimation method.

BACKGROUND ART

Conventionally, future room temperatures of a living room whose temperature is adjusted by an air conditioner have been estimated to provide comfortable air conditioning for a user while power consumption is suppressed. For example, Patent Literature 1 discloses a technique for predicting, on the basis of the room temperature history information and the operation history information of an air conditioner, a future room temperature of a living room when the air conditioner is not adjusting the temperature as an OFF-state predicted room temperature and a future room temperature of a living room when the air conditioner is adjusting the temperature as an ON-state predicted room temperature.

PRIOR ART REFERENCE

Patent Reference

Patent Literature 1: Japanese Patent Application Publication No. 2017-67427

SUMMARY OF THE INVENTION

Problem to be Solved by the Invention

However, room temperature is affected by, for example, both the external environmental conditions, such as atmospheric temperature, and the operation of temperature control devices, such as air conditioners. The technique disclosed in Patent Literature 1 treats these effects collectively, and thus the relationship between the room temperature and these factors is complicated. For example, when the room temperature while the temperature control device is turned off is to be predicted according to Patent Literature 1, the room temperature is affected by the temperature control device for a certain period of time after the temperature control device is switched from an on-state to an off-state. The room temperature is also affected by the external environment. Hence, the model for room temperature estimation is complex.

Thus, when a model having a high load and a large volume of data to be processed or stored during the use of the model is learned through machine learning or the like, there is a problem in that the time period of learning data accumulation is long and the start of the service using estimated room temperature is delayed because the number of data items required to satisfy the necessary estimation accuracy is large.

Accordingly, an object of one or more aspects of the disclosure is to simplify a model that estimates room temperature.

Means of Solving the Problem

A indoor-temperature estimation apparatus according to a first aspect of the disclosure includes: a room-temperature-history-information storage unit configured to store room temperature history information indicating a history of learning room temperature, the learning room temperature being room temperature in a learning period, the room temperature being indoor temperature, the learning period being a period during which learning of the room temperature is performed; an operation-history-information storage unit configured to store operation history information indicating an operation history of a temperature control device controlling the room temperature in the learning period; an external-environment-information storage unit configured to store learning external environment information indicating a learning state, the learning state being a state of an outdoor in the learning period; an effect determining unit configured to specify a learning affected period and a learning unaffected period from the operation history information, the learning affected period being a period during which the room temperature is affected by the temperature control device in the learning period, the learning unaffected period being a period during which the room temperature is unaffected by the temperature control device in the learning period; a room-temperature-model generating unit configured to refer to the room temperature history information and the learning external environment information and learn the learning state and the learning room temperature in the learning unaffected period, to generate a room temperature model indicating a relationship between the state and the room temperature; an unaffected-room-temperature estimating unit configured to refer to the learning external environment information and estimate a learning temporary room temperature by using the room temperature model, the learning temporary room temperature being the room temperature of when a presumption is made that the temperature control device has no effect in the learning affected period; and a room-temperature-change-model generating unit configured to refer to the room temperature history information and the operation history information and learn the learning room temperature and the learning temporary room temperature in the learning affected period, to generate a room temperature change model indicating a change in the room temperature caused by the temperature control device.

A indoor-temperature estimation apparatus according to a second aspect of the disclosure includes: an operation-plan-information storage unit configured to store operation plan information indicating an operation plan of a temperature control device controlling room temperature during a target period during which room temperature is estimated, the room temperature being indoor temperature; an external-environment-information storage unit configured to store target external environment information indicating a target state, the target state being a state of an outdoor during the target period; a room-temperature-model storage unit configured to store a room temperature model indicating a relationship between the state and the room temperature; a room-temperature-change-model storage unit configured to store a room temperature change model indicating a change in the room temperature caused by the temperature control device; an effect determining unit configured to refer to the operation plan information and specify a target affected period and a target unaffected period, the target affected period being a period during which the room temperature is affected by the temperature control device in the target period, the target unaffected period being a period during which the room temperature is not affected by the temperature control device in the target period; an unaffected-room-temperature estimating unit configured to refer to the target external environment information to estimate a first estimated room temperature from the target state by using the room temperature model, the first estimated room temperature being the room temperature in the target period; an affected-room-temperature estimating unit configured to refer to the operation plan information to estimate a change in the room temperature in the target affected period from a set temperature of the temperature control device in the target affected period and the first estimated room temperature by using the room temperature change model, to estimate a second estimated room temperature, the second estimated room temperature being the room temperature in the target affected period; and an integrating unit configured to integrate the first estimated room temperature and the second estimated room temperature to generate an estimated result of the room temperature in the target period.

A program according to a first aspect of the disclosure causes a computer to function as: a room-temperature-history-information storage unit configured to store room temperature history information indicating a history of learning room temperature, the learning room temperature being room temperature in a learning period, the room temperature being indoor temperature, the learning period being a period during which learning of the room temperature is performed; an operation-history-information storage unit configured to store operation history information indicating an operation history of a temperature control device controlling the room temperature in the learning period; an external-environment-information storage unit configured to store learning external environment information indicating a learning state, the learning state being a state of an outdoor in the learning period; an effect determining unit configured to specify a learning affected period and a learning unaffected period from the operation history information, the learning affected period being a period during which the room temperature is affected by the temperature control device in the learning period, the learning unaffected period being a period during which the room temperature is unaffected by the temperature control device in the learning period; and a room-temperature-model generating unit configured to refer to the room temperature history information and the learning external environment information and learn the learning state and the learning room temperature in the learning unaffected period, to generate a room temperature model indicating a relationship between the state and the room temperature history information; an unaffected-room-temperature estimating unit configured to refer to the learning external environment information and estimate a learning temporary room temperature by using the room temperature model, the learning temporary room temperature being the room temperature of when a presumption is made that the temperature control device has no effect in the learning affected period; and a room-temperature-change-model generating unit configured to refer to the room temperature history information and the operation history information and learn the learning room temperature and the learning temporary room temperature in the learning affected period, to generate a room temperature change model indicating a change in the room temperature caused by the temperature control device.

A program according to a second aspect of the disclosure causes a computer to function as: an operation-plan-information storage unit configured to store operation plan information indicating an operation plan of a temperature control device controlling room temperature in a target period during which the room temperature is estimated, the room temperature being indoor temperature; and an external-environment-information storage unit configured to store target external environment information indicating a target state, the target state being a state of an outdoor in the target period; a room-temperature-model storage unit configured to store a room temperature model indicating a relationship between the state and the room temperature; a room-temperature-change-model storage unit configured to store a room temperature change model indicating a change in the room temperature caused by the temperature control device; an effect determining unit configured to refer to the operation plan information to specify a target affected period and a target unaffected period, the target affected period being a period during which the room temperature is affected by the temperature control device in the target period, the target unaffected period being a period during which the room temperature is not affected by the temperature control device in the target period, an unaffected-room-temperature estimating unit configured to refer to the target external environment information to estimate a first estimated room temperature from the target state by using the room temperature model, the first estimated room temperature being the room temperature in the target period; an affected-room-temperature estimating unit configured to refer to the operation plan information to estimate a change in the room temperature in the target affected period from a set temperature of the temperature control device in the target affected period and the first estimated room temperature by using the room temperature change model, to estimate a second estimated room temperature, the second estimated room temperature being the room temperature in the target affected period; and an integrating unit configured to integrate the first estimated room temperature and the second estimated room temperature to generate an estimated result of the room temperature in the target period.

A indoor-temperature estimation method according to a first aspect of the disclosure includes: specifying a learning affected period and a learning unaffected period from operation history information indicating an operation history of a temperature control device controlling room temperature in a learning period during which learning is performed, the room temperature being indoor temperature, the learning affected period being a period during which the room temperature is affected by the temperature control device in the learning period, the learning unaffected period being a period during which the room temperature is unaffected by the temperature control device in the learning period; referring to learning external environment information indicating a learning state in relation to room temperature history information indicating a history of learning temperature and a state of an outdoor, and learn the learning state and the learning temperature in the learning unaffected period to generate a room temperature model indicating a relationship between the state and the room temperature, the learning state being the state in the learning period; referring to the learning external environment information and estimating a learning temporary room temperature by using the room temperature model, the learning temporary room temperature being the room temperature of when a presumption is made that the temperature control device has no effect in the learning affected period; and referring to the room temperature history information and the operation history information and learning the learning room temperature and the learning temporary room temperature in the learning affected period, to generate a room temperature change model indicating a change in the room temperature caused by the temperature control device.

A indoor-temperature estimation method according to a second aspect of the disclosure includes: referring to operation plan information indicating an operation plan of a temperature control device controlling room temperature in a target period during which the room temperature is estimated, to specify a target affected period and a target unaffected period, the room temperature being indoor temperature, the target affected period being a period during which the room temperature is affected by the temperature control device in the target period, the target unaffected period being a period during which the room temperature is not affected by the temperature control device in the target period; referring to target external environment information indicating a target state in the target period, to estimate a first estimated room temperature from the target state by using a room temperature model, the target state being a state of an outdoor in the target period, the first estimated room temperature being the room temperature in the target period, the room temperature model indicating a relationship between the state and the room temperature; referring to the operation plan information to estimate a change in the room temperature in the target affected period from a set temperature of the temperature control device in the target affected period and the first estimated room temperature by using a room temperature change model indicating a change in the room temperature caused by the temperature control device, to estimate a second estimated room temperature, the second estimated room temperature being the room temperature in the target affected period; and an integrating unit configured to integrate the first estimated room temperature and the second estimated room temperature to generate an estimated result of the room temperature in the target period.

Effects of the Invention

According to one or more aspects of the disclosure, a model that estimates room temperature can be simplified.

MODE FOR CARRYING OUT THE INVENTION

Figure 1:
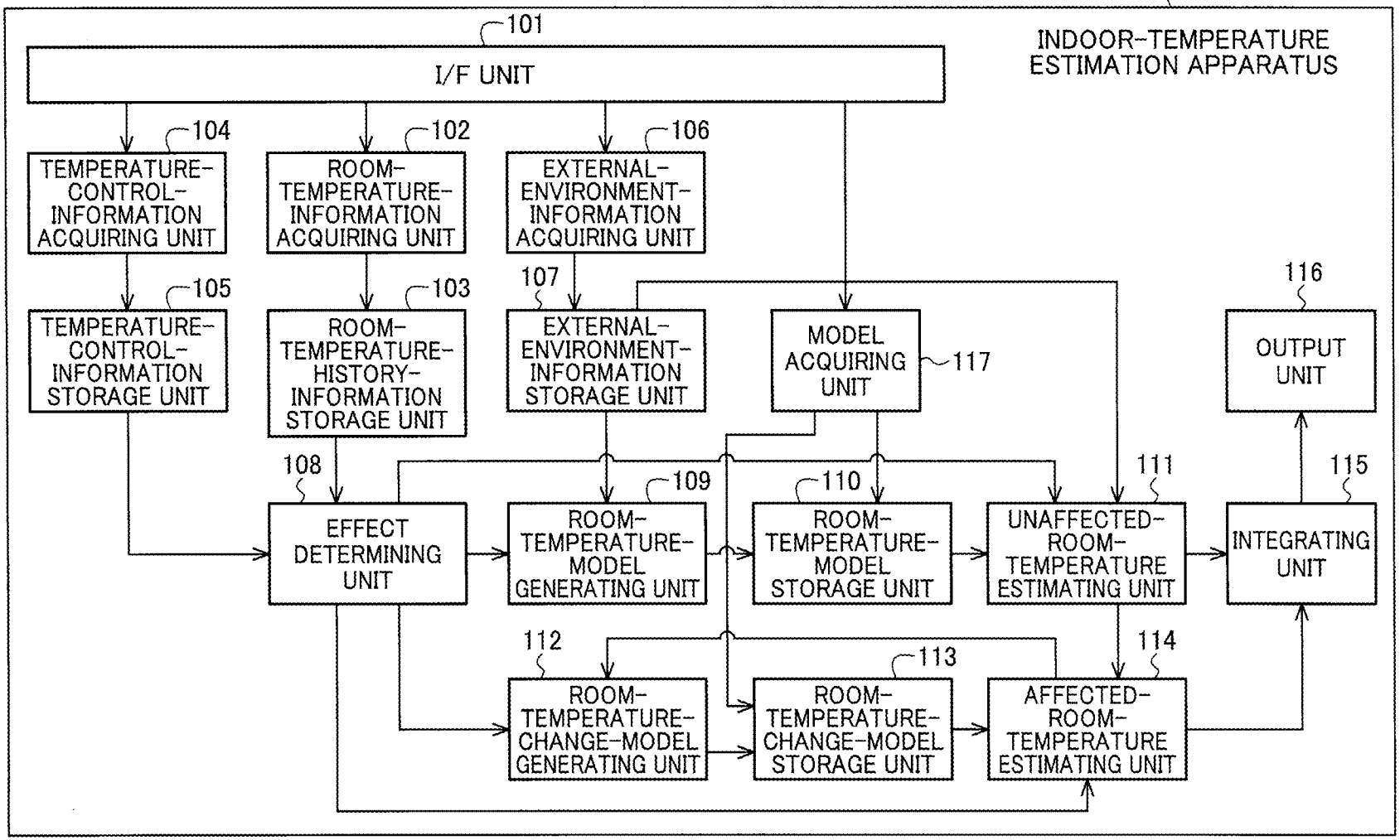
FIG. 1 is a block diagram schematically illustrating the configuration of an indoor-temperature estimation apparatus according to an embodiment.

FIG. 1 is a block diagram schematically illustrating the configuration of an indoor-temperature estimation apparatus 100 according to an embodiment.

The indoor-temperature estimation apparatus 100 includes an interface unit (I/F unit) 101, a room-temperature-information acquiring unit 102, a room-temperature-history-information storage unit 103, a temperature-control-information acquiring unit 104, a temperature-control-information storage unit 105, an external-environment-information acquiring unit 106, an external-environment-information storage unit 107, an effect determining unit 108, a room-temperature-model generating unit 109, a room-temperature-model storage unit 110, an unaffected-room-temperature estimating unit 111, a room-temperature-change-model generating unit 112, a room-temperature-change-model storage unit 113, an affected-room-temperature estimating unit 114, an integrating unit 115, an output unit 116, and a model acquiring unit 117.

In the present embodiment, the indoor-temperature estimation apparatus 100 that estimates room temperature will be described. The indoor-temperature estimation apparatus 100 estimates future, present, or past room temperature as needed.

The I/F unit 101 communicates with other devices. For example, the I/F unit 101 is connected to a network and communicates with other devices.

The room-temperature-information acquiring unit 102 acquires room temperature information indicating the room temperature, which is the temperature of a room that is an estimation target. The room-temperature-information acquiring unit 102 acquires room temperature information, for example, from an indoor sensor or the like connected to a network (not illustrated) via the I/F unit 101. The room-temperature-information acquiring unit 102 stores the acquired room temperature information together with the date and time as room temperature history information in the room-temperature-history-information storage unit 103.

The room-temperature-history-information storage unit 103 stores the room temperature history information. The room temperature history information indicates the date and time, and room temperature. It is presumed that the room-temperature-history-information storage unit 103 stores, as the room temperature history information, at least the history of learning room temperature that is the room temperature during a learning period during which learning is performed.

The temperature-control-information acquiring unit 104 acquires temperature control information related to the operation of a temperature control device that affects the temperature of the room that is an estimation target. The temperature control information includes operation plan information indicating an operation plan of the temperature control device in a target period during which room temperature is estimated, and operation history information indicating the operation history of the temperature control device before the target period. The temperature-control-information acquiring unit 104 acquires the temperature control information, for example, from an indoor temperature control device connected to a network (not illustrated) via the I/F unit 101. The temperature control device is, for example, an air conditioner, but alternatively may be any device capable of controlling the temperature of a room, such as an oil fan heater, a gas fan heater, a stove, a water heater, a central heating system, a floor heating system cooling fan, or a dry mist system.

The temperature-control-information storage unit 105 stores the temperature control information. The temperature control information includes the operation plan information and the operation history information, as described above. Thus, the temperature-control-information acquiring unit 104 functions as an operation-plan-information storage unit that stores operation plan information and an operation-history-information storage unit that stores operation history information. The operation history information is presumed to include the operation history of the temperature control device during at least the learning period.

The external-environment-information acquiring unit 106 acquires external environment information indicating an outdoor environmental state of the outside of the room that is an estimation target. The external environment information is, for example, weather information of the region to which the room belongs. For example, the external environment information includes at least target external environment information indicating a target state that is the outdoor state in a target period, and state history information indicating the outdoor state before the target period. The external environment information may indicate humidity, insolation, weather, cloudiness, precipitation, atmospheric pressure, wind speed, etc., in addition to atmospheric temperature. The external environment information is acquired, for example, from a service provider that provides weather information and is connected to a network (not illustrated) via the T/F unit 101, or from an outdoor sensor connected to a network (not illustrated).

If the target period is in the future, the external-environment-information acquiring unit 106 may acquire future atmospheric temperature in a weather forecast as target external environment information, or may predict the future atmospheric temperature from the atmospheric temperature acquired by an outdoor sensor and use the predicted atmospheric temperature as the target external environment information.

The external-environment-information storage unit 107 stores the external environment information. The external environment information includes the target external environment information and state history information, as described above. Thus, the external-environment-information storage unit 107 functions as a target-external-environment-information storage unit that stores target external environment information and a state-history-information storage unit that stores state history information. The state history information includes learning external environment information indicating a learning state that is the state in a learning period.

The effect determining unit 108 determines whether or not the room temperature is affected by the temperature control device during a certain period on the basis of the temperature control information stored in the temperature-control-information storage unit 105. The certain period includes the past, the present, and the future. Specifically, the effect determining unit 108 determines a period during which the temperature control device is turned on and a predetermined period from the start of the off-state of the temperature control device as affected periods, and determines periods other than the affected periods as unaffected periods.

The predetermined period is, for example, a period from the start of the off-state, specifically, four hours. As will be described below, the effect of the temperature control device attenuates over time after the start of the off-state. Thus, the effect is significant immediately after the start of the off-state and becomes more negligible over time. Since the speed of attenuation varies depending on the case, the predetermined period is preferably determined in accordance with the situation.

For example, the period may be determined in accordance with the materials of the building, such as four hours if the building to which the room belongs is made of wood and six hours if it is made of reinforced concrete. Alternatively, the period may be determined on the basis of the layout, size, window size, ventilation, or heat insulation of the room. Alternatively, the period may be determined on the basis of a room temperature change model, as will be described below. Alternatively, the period may be changed depending on the data acquisition status. For example, a period of four hours may be used before sufficient learning is performed, and after the room temperature change model is learned, the period may be determined on the basis of the room temperature change model.

Specifically, the effect determining unit 108 specifies, in the learning period, learning affected periods that are periods during which the room temperature is affected by the temperature control device and learning unaffected periods that are periods during which the room temperature is not affected by the temperature control device.

The learning affected periods in the learning period are periods during which the temperature control device is turned on and predetermined periods after the temperature control device is turned off. The learning unaffected periods are the periods other than the learning affected periods in the learning period.

The effect determining unit 108 specifies, in the target period, target affected periods that are periods during which the room temperature is affected by the temperature control device and target unaffected periods that are periods during which the room temperature is not affected by the temperature control device.

The target affected periods in the target period are periods during which the temperature control device is turned on and predetermined periods after the temperature control device is turned off. The target unaffected periods are periods other than the target affected periods in the target period.

The room-temperature-model generating unit 109 refers to the room temperature history information and the learning external environment information and learns the learning state and the learning room temperature in the learning unaffected periods to generate a room temperature model indicating the relationship between the outdoor state and the room temperature.

For example, the room-temperature-model generating unit 109 generates a room temperature model by learning the room temperature in the unaffected periods of the temperature control device on the basis of room temperature learning data prepared on the basis of the room temperature history information and the external environment information. In other words, the room-temperature-model generating unit 109 generates a room temperature model that is a learned model for estimating the optimal room temperature in the unaffected period from the room temperature history information and the external environment information.

Here, the room temperature learning data is data in which the room temperature indicated in the room temperature history information and the state indicated in the external environment information in the unaffected period included in the learning period are correlated with each other.

The room-temperature-model storage unit 110 stores the room temperature model. The room temperature model may be generated by the room-temperature-model generating unit 109 or may be acquired by the model acquiring unit 117 from a network (not illustrated) via the I/F unit 101, as will be described below.

The unaffected-room-temperature estimating unit 111 estimates the room temperature from an unaffected room temperature model stored in the room-temperature-model storage unit 110, the room temperature history information, and the external environment information.

For example, the unaffected-room-temperature estimating unit 111 refers to the learning external environment information and uses the room temperature model to estimate the learning temporary room temperature, which is the room temperature presumed to be unaffected by the temperature control device, in the learning affected period. The learning temporary room temperature is given to the affected-room-temperature estimating unit 114.

The unaffected-room-temperature estimating unit 111 also refers to the target external environment information and uses the room temperature model to estimate, from the target state, a first estimated room temperature, which is the room temperature in the target period. The first estimated room temperature is given to the affected-room-temperature estimating unit 114 and the integrating unit 115.

The room-temperature-change-model generating unit 112 refers to the room temperature history information and the operation history information to learn the learning room temperature and the learning temporary room temperature in the learning affected period, to generate a room temperature change model indicating the change in the room temperature caused by the temperature control device.

For example, the room-temperature-change-model generating unit 112 learns the room temperature change in the affected period of the temperature control device on the basis of room-temperature-change learning data generated on the basis of the room temperature history information and the temperature control information. In other words, the room-temperature-change-model generating unit 112 generates a room temperature change model that is a learned model for estimating an optimal room temperature change during the affected period from the room temperature history information and the temperature control information. The room-temperature-change learning data is data generated from the room temperature indicated by the room temperature history information in the affected period included in the learning period and the operating state of the temperature control device indicated by the temperature control information in the affected period.

Specifically, the room-temperature-change-model generating unit 112 generates, as a room temperature change model, an on-state room temperature change model and an off-state room temperature change model. The room-temperature-change-model generating unit 112 generates the on-state room temperature change model that indicates a change in the room temperature from the time the temperature control device is turned on to the time the temperature control device is turned off, by learning a temperature difference between the learning temporary room temperature at the time the temperature control device is turned on and a set information in temperature of the temperature control device, and the learning room temperature in time-series after the temperature control device is turned on. The room-temperature-change-model generating unit 112 generates the off-state room temperature change model that indicates a change in the room information in temperature from the time the temperature control device is turned off until the predetermined period passes, by learning a temperature difference between the learning temporary room temperature at the time the temperature control device is turned off and the learning room temperature at the time the temperature control device is turned off, and the learning room temperature in time-series after the temperature control device is turned off.

The room-temperature-change-model storage unit 113 stores the room temperature change model. The room temperature change model may be generated by the room-temperature-change-model generating unit 112 or may be acquired by the model acquiring unit 117 from a network (not illustrated) via the I/F unit 101, as will be described below.

The affected-room-temperature estimating unit 114 estimates affected room temperature that is the room temperature affected by the temperature control device from the room temperature change model stored in the room-temperature-change-model storage unit 113, the room temperature history information, and the temperature control information.

For example, the affected-room-temperature estimating unit 114 refers to the operation plan information and estimates the room temperature change during the target affected period from the set temperature of the temperature control device in the target affected period and the target temporary room temperature by using the room temperature change model, to estimate the affected room temperature that is room temperature during the target affected period. The affected room temperature is also referred to as a second estimated room temperature.

The integrating unit 115 integrates the unaffected room temperature estimated by the unaffected-room-temperature estimating unit 111 and the affected room temperature estimated by the affected-room-temperature estimating unit 114 to generate estimated room temperature information indicating an integrated room temperature estimated result that is an estimated result of the room temperature during the target period. For example, the integrating unit 115 can generate the integrated room temperature estimated result by connecting the room temperature estimated in the affected period and the room temperature estimated in the unaffected period. The estimated room temperature information is given to the output unit 116.

The output unit 116 outputs the estimated room temperature information. For example, the output unit 116 may cause a display unit (not illustrated), such as a display, to display the estimated room temperature information or may send the estimated room temperature information to another device connected to a network (not illustrated) via the I/F unit 101.

The model acquiring unit 117 acquires a room temperature model from a network via the I/F unit 101 and stores the room temperature model in the room-temperature-model storage unit 110.

The model acquiring unit 117 acquires a room temperature change model from a network via the I/F unit 101 and stores the room temperature change model in the room-temperature-change-model storage unit 113.

For example, when the room-temperature-model generating unit 109 does not generate the room temperature model, the model acquiring unit 117 may acquire the room temperature model, and when the room-temperature-change-model generating unit 112 does not generate the room temperature change model, the model acquiring unit 117 may acquire the room temperature change model.

Figure 2:
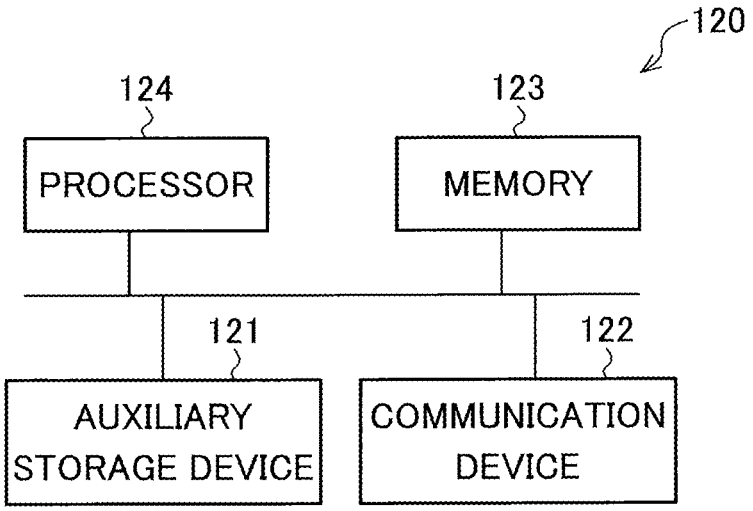
FIG. 2 is a block diagram illustrating an example computer.

The indoor-temperature estimation apparatus 100 described above can be implemented by a computer 120 as illustrated in FIG. 2.

As illustrated in FIG. 2, the computer 120 includes an auxiliary storage device 121, a communication device 122, a memory 123, and a processor 124.

The auxiliary storage device 121 stores programs and data necessary for processing by the indoor-temperature estimation apparatus 100.

The communication device 122 communicates with other devices.

The memory 123 provides a work area for the processor 124.

The processor 124 executes the processing at the indoor-temperature estimation apparatus 100.

For example, the room-temperature-information acquiring unit 102, the temperature-control-information acquiring unit 104, the external-environment-information acquiring unit 106, the effect determining unit 108, the room-temperature-model generating unit 109, the unaffected-room-temperature estimating unit 111, the room-temperature-change-model generating unit 112, the affected-room-temperature estimating unit 114, the integrating unit 115, the output unit 116, and the model acquiring unit 117 can be implemented by the processor 124 loading programs stored in the auxiliary storage device 121 to the memory 123 and executing these programs.

The room-temperature-history-information storage unit 103, the temperature-control-information storage unit 105, the external-environment-information storage unit 107, the room-temperature-model storage unit 110, and the room-temperature-change-model storage unit 113 can be implemented by the processor 124 using the auxiliary storage device 121.

The I/F unit 101 can be implemented by the processor 124 using the communication device 122.

Such programs may be provided via a network or may be recorded and provided on a recording medium. That is, such programs may be provided as, for example, program products.

The indoor-temperature estimation apparatus 100 may be built into the temperature control device or may be provided as a separate device. The indoor-temperature estimation apparatus 100 may reside on a cloud server. The indoor-temperature estimation apparatus 100 may be divided into multiple parts that are implemented by multiple devices.

The operation of the indoor-temperature estimation apparatus 100 will now be explained. The indoor-temperature estimation apparatus 100 operates in two different phases: a learning phase and a utilization phase. The learning phase and the utilization phase need not to operate in different periods and may be repeated alternately or executed in parallel.

Learning Phase

The process of the indoor-temperature estimation apparatus 100 learning a model will now be explained with reference to FIG. 3.

Figure 3:
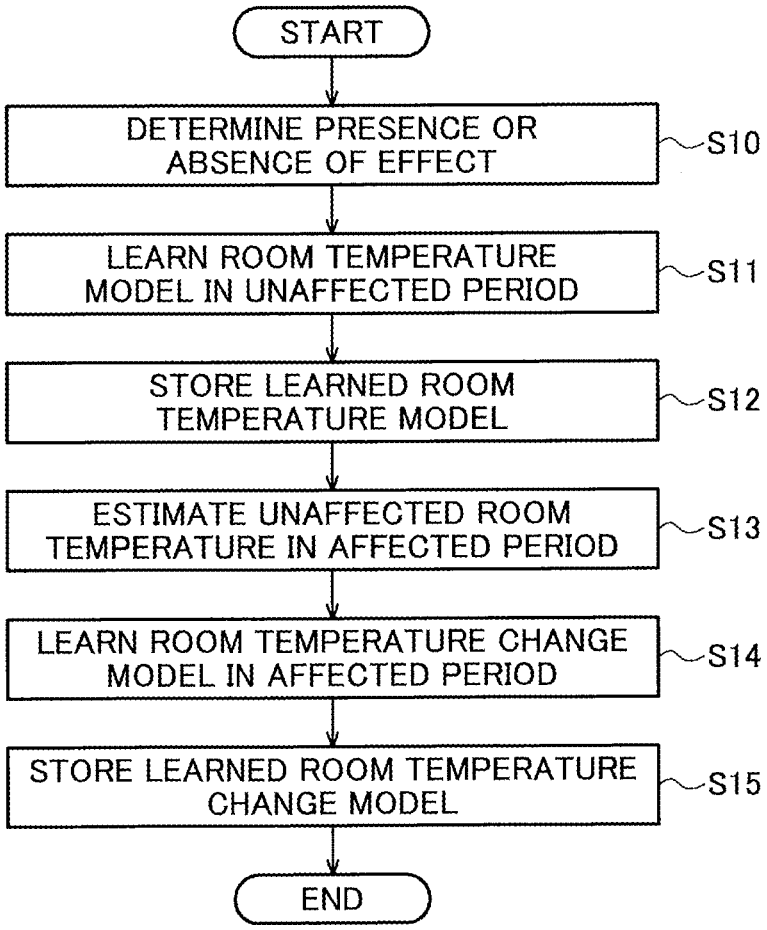
FIG. 3 is a flowchart illustrating a learning process of an indoor-temperature estimation apparatus.

FIG. 3 is a flowchart illustrating the learning process of the indoor-temperature estimation apparatus 100.

The order of the steps in this flowchart is an example, and the order may be changed.

The room-temperature-history-information storage unit 103, the temperature-control-information storage unit 105, and the external-environment-information storage unit 107 store the necessary information through the room-temperature-information acquiring unit 102, the temperature-control-information acquiring unit 104, and the external-environment-information acquiring unit 106, respectively.

Figure 4:
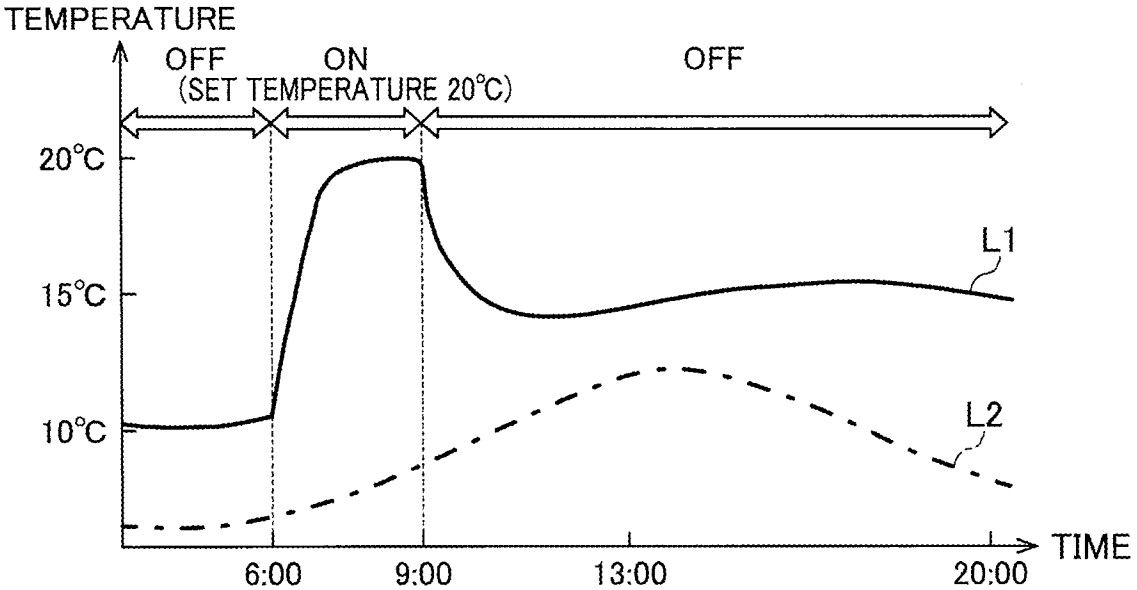
FIG. 4 is a graph illustrating an example of room temperature history information, temperature control information, and external environment information used in a learning process of an indoor-temperature estimation apparatus.

FIG. 4 is a graph illustrating an example of the room temperature history information, the temperature control information, and the external environment information used in the learning process of the indoor-temperature estimation apparatus 100.

For example, FIG. 4 illustrates information on the day before the day on which the learning process is to be performed, and the temperature control device is an air conditioner for performing air conditioning, and the room is a room in a wooden house. In the example illustrated in FIG. 4, the learning period is the day before the day on which the learning process is to be performed.

The solid line L1 in FIG. 4 represents the room temperature indicated in the room temperature history information.

The dash-dotted line L2 in FIG. 4 represents the atmospheric temperature indicated in the external environment information. In this example, the atmospheric temperature is that observed in the region to which the room belongs.

The arrows and the terms "ON" and "OFF" in FIG. 4 represent the operating states indicated in the temperature control information. In the day in this example, the air conditioner is turned off from 0:00 a.m. to 6:00 a.m. The air conditioner is turned on from 6:00 a.m. to 9:00 a.m., and its set temperature is 20° C. The air conditioner is turned off from 9:00 a.m. to 12:00 p.m. The learning process will now be explained using this example.

Referring back to FIG. 3, first, the effect determining unit 108 determines the affected period during which the room temperature is affected by the temperature control device and the unaffected period during which the room temperature is not affected by the temperature control device, on the basis of the operation history information included in the temperature control information (step S10). The affected period is also referred to as the learning affected period, and the unaffected period is also referred to as the learning unaffected period.

Figure 5:
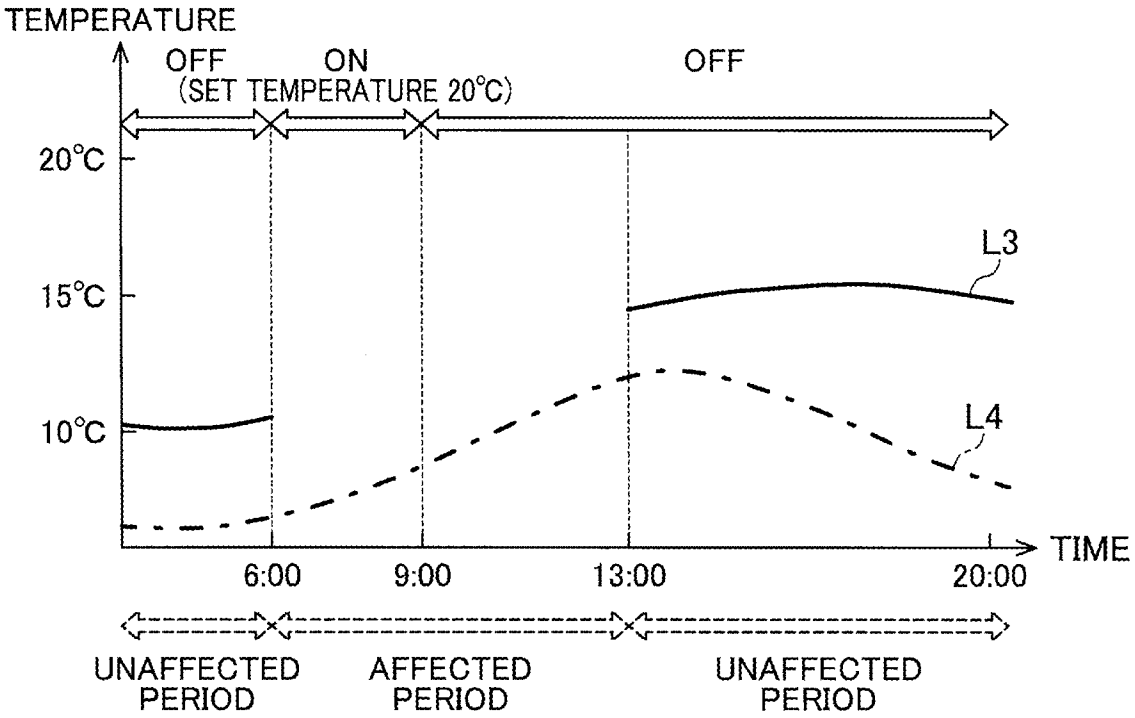
FIG. 5 is a graph illustrating an example of room temperature and atmospheric temperature in an unaffected period used for learning.

FIG. 5 illustrates an example of the result of effect determination. In FIG. 5, the result of the determination is indicated by the dotted arrows.

As illustrated in FIG. 5, the period during which the temperature control device is turned on, that is, from 6:00 a.m. to 9:00 a.m., is an affected period. A predetermined period after the temperature control device is turned off to enter an off-state is also an affected period. In this example, the predetermined period is four hours from the start of the off-state. Hence, the period between 9:00 a.m. and 1:00 p.m. is an affected period. The periods other than the affected period are unaffected periods and in the day in this example the periods between 0:00 a.m. and 6:00 a.m. and 1:00 p.m. and 12:00 p.m. are the unaffected periods.

The predetermined period is set to four hours in this example because the effect of the temperature control device is almost eliminated after four hours from the start of the off-state, and this will be explained in detail below when the generation of the room temperature change model is explained.

Referring back to FIG. 3, the room-temperature-model generating unit 109 uses the room temperature learning data based on the combination of the room temperature history information and the external environment information, to learn the room temperature in the unaffected period through supervised learning, and generates a learned model (step S11). Here, supervised learning refers to a method of inferring output from input by giving learning data including combinations of inputs and outputs (correct answers) to a learning device to learn features in the learning data.

The solid lines L3 in FIG. 5 represent an example of the room temperature in the unaffected periods used for learning. The room temperature here is also referred to as learning room temperature.

The dash-dotted line L4 in FIG. 5 represents an example of the atmospheric temperature used for learning. The atmospheric temperature here is also referred to as learning atmospheric temperature that is a learning state.

The learning data in this example is data in which the atmospheric temperature and the room temperature (correct answer) in the unaffected periods are correlated with each other. As an example of such correlation, the room temperature at the estimation target time (for example, 8:00 p.m.) is an output (correct answer), and the atmospheric temperature at the same time, the atmospheric temperature in the past (for example, at 7:00 p.m. as an hour before it), and the room temperature in the past (for example, at 7:00 p.m. as an hour before it) are model inputs.

Since the temperature of the building to which the room belongs is affected by the atmospheric temperature, it is preferable to use the atmospheric temperature as an input. Since the building is affected by the past external environment through heat accumulation, it is preferable to use the past atmospheric temperature as an input. Similarly, since the room is affected by the past room temperature through heat accumulation, it is preferable to use the past room temperature as an input.

Since the building is heated by insolation, it is preferable to use insolation as an additional input. Since the building is affected by humidity or precipitation, it is preferable to use humidity or precipitation as an additional input. Moreover, weather, cloudiness, atmospheric pressure, wind speed, etc., may be used as an input.

The number of inputs may be reduced in such a manner that output can be obtained from a small number of inputs. For example, if only atmospheric temperature is used as a model input, estimated values can be obtained from the model even without the past room temperature. If only past room temperature is used as a model input, estimated values can be obtained from the model even without the atmospheric temperature. However, without the atmospheric temperature, the estimation accuracy will deteriorate as time passes from the time when the input room temperature is obtained.

The room-temperature-model generating unit 109 then performs learning in accordance with, for example, linear regression. Specifically, the room-temperature-model generating unit 109 learns a weighting coefficient so that the square error between the linear weighting sum of the inputs and the output (correct answer) is minimized.

The learning algorithm may be different from that mentioned above. For example, support vector regression, random forest regression, neural network models, or the like may be used. The room-temperature-model generating unit 109 generates a learned model by executing the learning described above.

Referring back to FIG. 3, the room-temperature-model storage unit 110 stores the room temperature model generated by the room-temperature-model generating unit 109 (step S12).

The unaffected-room-temperature estimating unit 111 then estimates the room temperature in the affected period by using the room temperature model stored in the room-temperature-model storage unit 110 (step S13). The estimated room temperature is also referred to as learning temporary room temperature.

Figure 6:
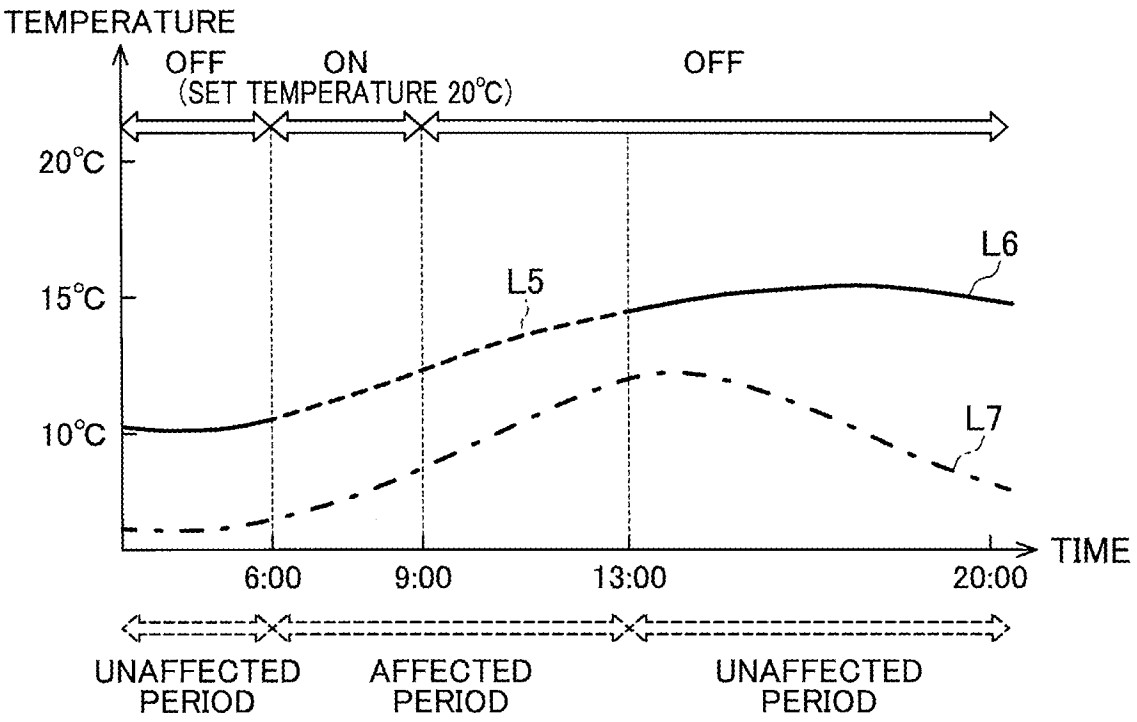
FIG. 6 is a graph illustrating an example of an estimated result of room temperature.

FIG. 6 is a graph illustrating an example of the estimated result of room temperature.

The dashed line L5 represents the room temperature estimated in step S13.

The affected period is a period in which there is an effect of the temperature control device, but since the room temperature model is obtained by learning the room temperature in the unaffected periods, the room temperature is estimated in step S13 under the assumption of no effect of the temperature control device.

The estimated result of room temperature is used for learning a room temperature change caused by the temperature control device. Step S13 is essential for learning the room temperature change representing the change between a case in which there is an effect of the temperature control device and a case in which there is no effect of the temperature control device. In reality, the room temperature not affected by the temperature control device cannot be detected during a period in which there is an effect of the temperature control device. Hence, the value of change between the room temperature affected by the temperature control device and the room temperature not affected by the temperature control device cannot be measured, and supervised learning cannot be performed. The unaffected room temperature cannot be detected but can be indirectly obtained through estimation using the room temperature model.

The solid lines L6 in FIG. 6 represent the room temperature in the unaffected period, and the dash-dotted line L4 represents the atmospheric temperature. These values are actually detectable.

Referring back to FIG. 3, the room-temperature-change-model generating unit 112 then learns the room temperature change in the affected period through supervised learning on the basis of the room temperature learning data based on the combinations of the room temperature history information, the temperature control information, and the external environment information, and generates a room temperature change model that is a learned model (step S14).

Figure 7:
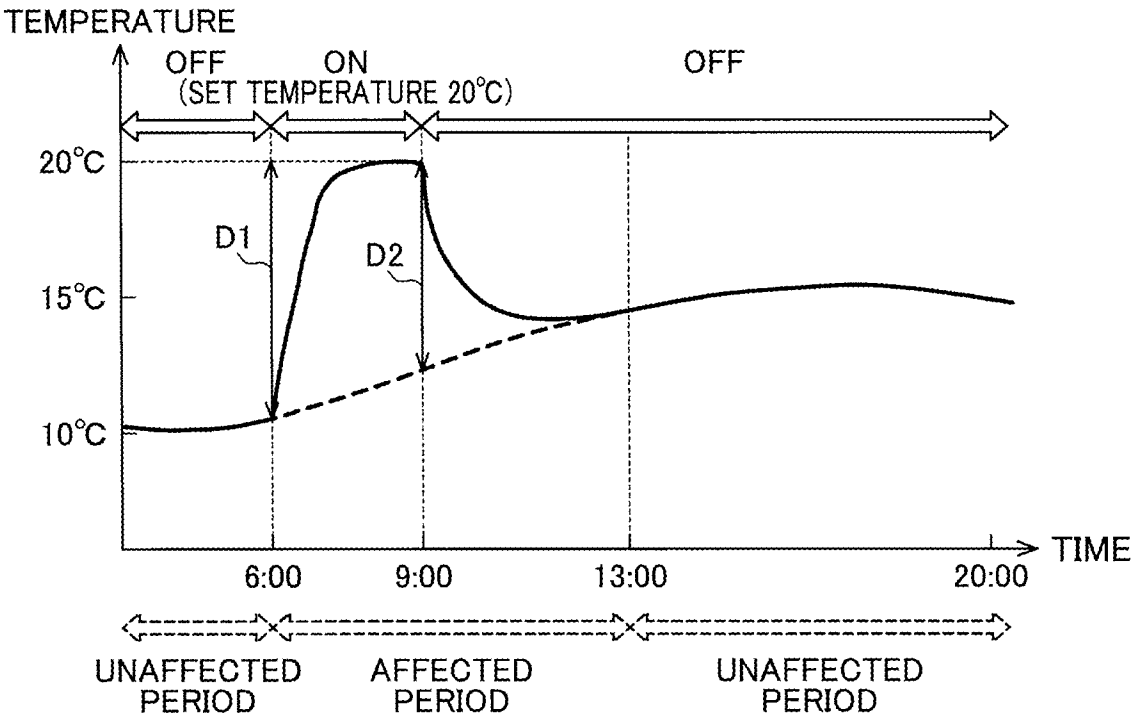
FIG. 7 is a graph for explaining a room temperature change model in an affected period.

FIG. 7 is a graph for explaining the room temperature change model in an affected period.

In the example illustrated in FIG. 7, the temperature control device is turned on at a set temperature of 20° C. at 6:00 a.m., when the room temperature is 10.5° C.

D1 is the temperature difference at the start of the on-state, which is the difference between the set temperature and the room temperature at 6:00 a.m. at the start of the on-state, and is 9.5° C.

The temperature control device is turned off at 9:00 a.m. when it is 19.9° C. The estimated unaffected room temperature at 9:00 a.m. is 12.2° C. This value is that estimated in step S13. D2 is the temperature difference at the start of the off-state, which is the difference between the room temperature and the estimated unaffected room temperature at 9:00 a.m. at the start of the off-state, and is 7.7° C.

For example, the room temperature change model can be generated in two parts: a post-on-state room temperature change model for the period during which the temperature control device is turned on, and a post-off-state room temperature change model for a predetermined period from the start of the off-state of the temperature control device.

During the period in which the temperature control device is turned on, the room temperature is assumed to approach the set temperature of the temperature control device. Thus, the temperature difference between the room temperature and the set temperature is assumed to attenuate in comparison with that at the start of the on-state. The degree of attenuation depends on the performance of the temperature control device, the room size, etc. Thus, it is desirable to learn a room temperature change model corresponding to each room in order to accurately estimate the room temperature change. However, it is also effective to acquire and use a learned model learned from rooms having similar attributes.

The room-temperature-change learning data in this example is data in which the input and the output are correlated with each other, where the temperature difference at the start of the on-state and the time passed from the start of the on-state are the input, and the temperature difference between the set temperature of the on-state period and the room temperature is the output (correct answer).

The room-temperature-change-model generating unit 112 prepares, for example, an exponential function, a linear function, or a power function as a model, selects a function that yields a minimum squared error or the like between the model output and the correct answer data, and determines a parameter characterizing the function. The model may be a sum of the functions mentioned above or may be a non-parametric model. The function may be learned by using a genetic algorithm or a neural network.

By executing such learning, a post-on-state room temperature change model is generated. Here, the output of the post-on-state room temperature change model may be the temperature difference between the set temperature and the room temperature, the room temperature estimated by subtracting the temperature difference from the set temperature, or an estimated room temperature change obtained by subtracting the estimated unaffected room temperature from the estimated room temperature. In the present embodiment, the post-on-state room temperature change model is presumed to output an estimated room temperature change.

For a predetermined period of time from the start of the off-state of the temperature control device, it is assumed that the temperature of the room that has been excessively heated or cooled by the temperature control device approaches an unaffected state by heat transfer. That is, it is assumed that the temperature difference between the room temperature and the estimated unaffected room temperature attenuates in comparison with that at the start of the off-state. The degree of attenuation depends on the thermal insulation performance of the room, the room size, etc. Thus, it is desirable to learn a room temperature change model corresponding to each room in order to estimate the room temperature change accurately. However, it is also effective to acquire and use a learned model learned from rooms having similar attributes.

The learning data in this example is data in which the input and the output are correlated with each other, where the temperature difference at the start of the off-state and the time passed from the start of the off-state are the input, and the temperature difference between the set temperature of the off-state period and the estimated unaffected room temperature is the output (correct answer).

The room-temperature-change-model generating unit 112 prepares, for example, an exponential function, a linear function, or a power function as a model, selects a function that yields a minimum squared error or the like between the model output and the correct answer data, and determines a parameter characterizing the function. The model may be a sum of the functions mentioned above or may be a non-parametric model. The function may be learned by using a genetic algorithm or a neural network. By executing such learning, a post-off-state room temperature change model is generated.

In the present embodiment, the post-off-state room temperature change model is modeled as an exponential function represented by Equation (1) below. If the heat transfer is due to heat conduction, the heat flow is proportional to the temperature difference, and the solution at that time is an exponential function.

$$\Delta T = \Delta T_{OFF} \exp(-\lambda t) \tag{1}$$

where t is the time passed from the start of the off-state, ΔT is the temperature difference between the room temperature at t time after the start of the off-state and the estimated unaffected room temperature, $\Delta T_{OFF}$ is the temperature difference between the room temperature at the start of the off-state and the estimated unaffected room temperature, and λ is the speed of attenuation.

In the present embodiment, λ=0.6. This is because λ=0.6 has been determined to be optimum when the room temperature change model was applied to the data of a wooden house.

According to the post-off-state room temperature change model, when $\Delta T_{OFF}$=7.7° C., as illustrated in FIG. 7, ΔT=0.7° C. is obtained after four hours, which is the predetermined period. If ΔT=0.7° C., the effect of the temperature control device is within the range of error, and it is preferable to determine that there is no effect. Since the average forecast error of the current maximum atmospheric temperature provided by the Japan Meteorological Agency exceeds 1° C., it is assumed that the accuracy of room temperature estimation is approximately 1° C. Hence, it can be assumed that less than 1° C. has no effect. Accordingly, it is preferable to set a threshold of a wooden house to four hours from the start of the off-state. The predetermined period may be determined on the basis of the post-off-state room temperature change model. The effect determining unit 108 may determine, for example, the affected period to be a period in which ΔT attenuates to 10% or less of $\Delta T_{OFF}$ and the unaffected period to be a period in which ΔT attenuates below this. Alternatively, the effect determining unit 108 may determine the affected period to be a period in which ΔT attenuates to 1° C. or less, and the unaffected period to be a period after that. The values given here are examples, and the predetermined period may be determined by other values.

Referring back to FIG. 3, the room-temperature-change-model storage unit 113 stores the room temperature change model generated by the room-temperature-change-model generating unit 112 (step S15). This step is omitted when the room temperature change model is not generated.

The indoor-temperature estimation apparatus 100 does not have to execute the flowchart illustrated in FIG. 3 when the room temperature model and the room temperature change model are not generated. In such a case, the model acquiring unit 117 may acquire the room temperature model and the room temperature change model from a network via the I/F unit 101. The model acquiring unit 117 then may store the room temperature model in the room-temperature-model storage unit 110 and the room temperature change model in the room-temperature-change-model storage unit 113. In such a case, it is desirable to generate the room temperature model and the room temperature change model through a process similar to that of the flowchart illustrated in FIG. 3.

Utilization Phase

The process of the indoor-temperature estimation apparatus 100 estimating room temperature will now be described with reference to FIG. 8.

Figure 8:
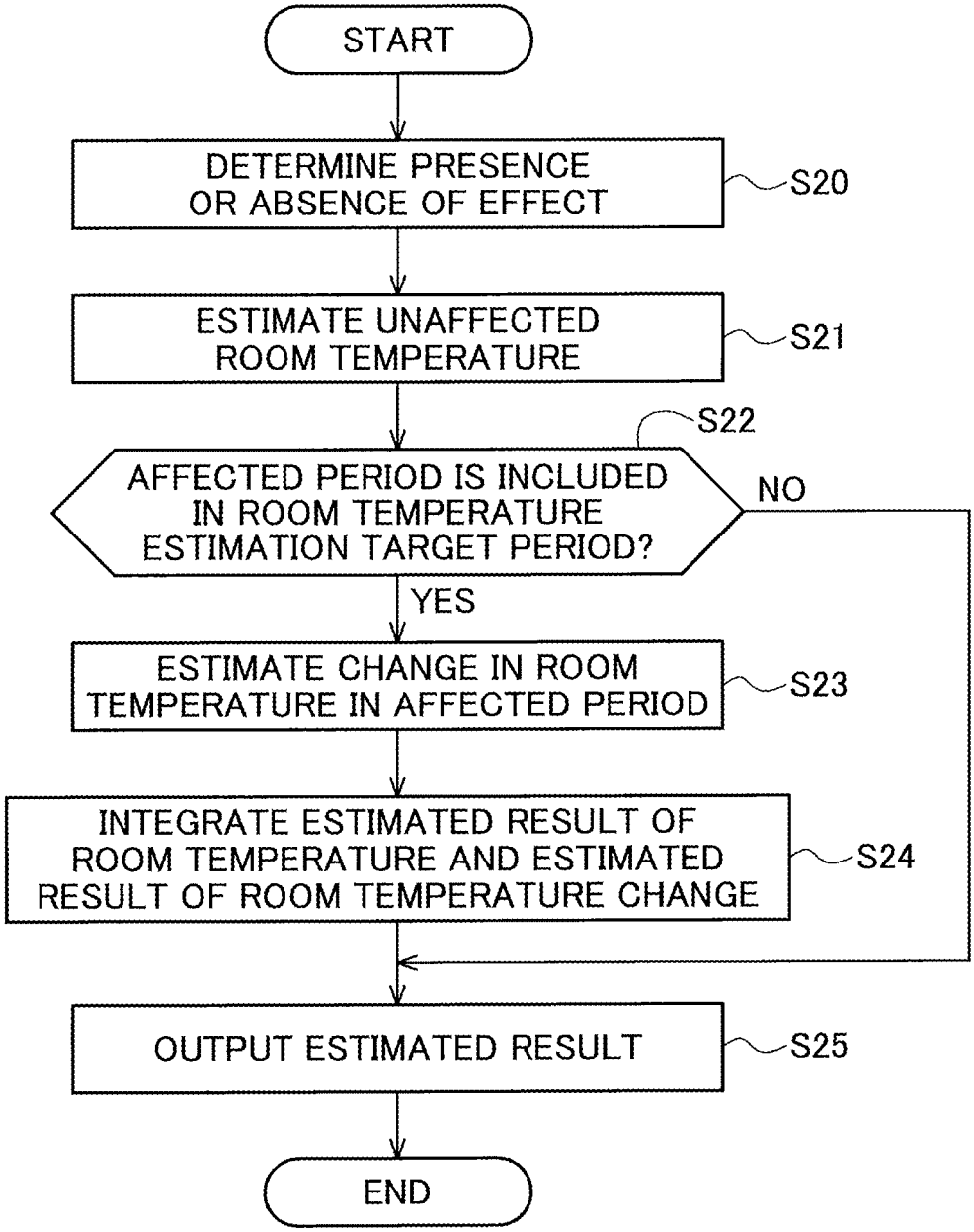
FIG. 8 is a flowchart illustrating an estimation process of an indoor-temperature estimation apparatus.

FIG. 8 is a flowchart illustrating the estimation process of the indoor-temperature estimation apparatus 100.

The order of the steps in this flowchart is an example, and the order may be changed.

The room-temperature-history-information storage unit 103, the temperature-control-information storage unit 105, and the external-environment-information storage unit 107 store the necessary information through the room-temperature-information acquiring unit 102, the temperature-control-information acquiring unit 104, and the external-environment-information acquiring unit 106, respectively.

Figure 9:
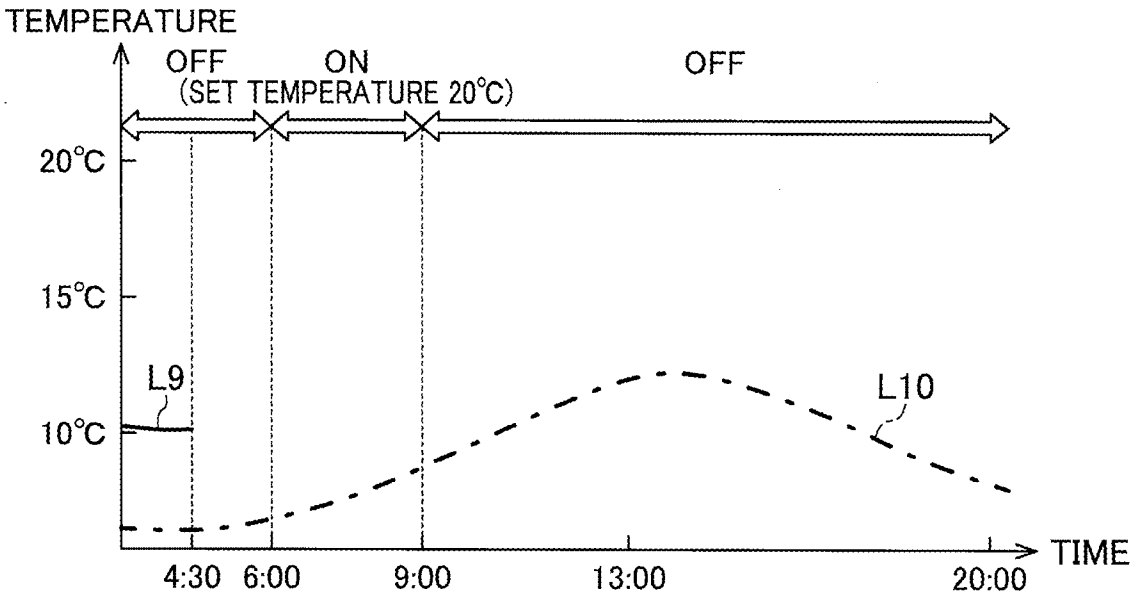
FIG. 9 is a graph illustrating an example of room temperature history information, temperature control information, and external environment information used in an estimation process of an indoor-temperature estimation apparatus.

FIG. 9 is a graph illustrating an example of the room temperature history information, the temperature control information, and the external environment information used in the estimation process by the indoor-temperature estimation apparatus 100.

For example, FIG. 9 illustrates the data of the day on which the estimation process is performed, and the temperature control device is specifically an air conditioner. The estimation process is performed at 4:30 a.m.

The solid line L9 in FIG. 9 represents the room temperature indicated in the room temperature history information stored in the room-temperature-history-information storage unit 103, and the room temperature until 4:30 a.m. when the estimation process is performed is stored.

The dash-dotted line L10 in FIG. 9 represents the atmospheric temperature indicated in the external environment information stored in the external-environment-information storage unit 107. In this example, the atmospheric temperature is forecast atmospheric temperature for the region to which the room belongs. The atmospheric temperature is target atmospheric temperature, which is a target state.

The arrows and the terms "ON" and "OFF" in FIG. 9 represent the operation plan indicated in the operation plan information included the temperature control information. In this example, the air conditioner is scheduled to be turned off between 0:00 a.m. and 6:00 a.m., turned on between 6:00 a.m. and 9:00 a.m. at a set temperature of 20° C., and turned off between 9:00 a.m. and 12:00 p.m.

The estimation process will now be explained using this example.

First, the effect determining unit 108 determines the affected period during which the room temperature is affected by the temperature control device and the unaffected period during which the room temperature is not affected by the temperature control device, on the basis of the operation plan information included in the temperature control information (step S20). The affected period is also referred to as the target affected period, and the unaffected period is also referred to as the target unaffected period.

Figure 10:
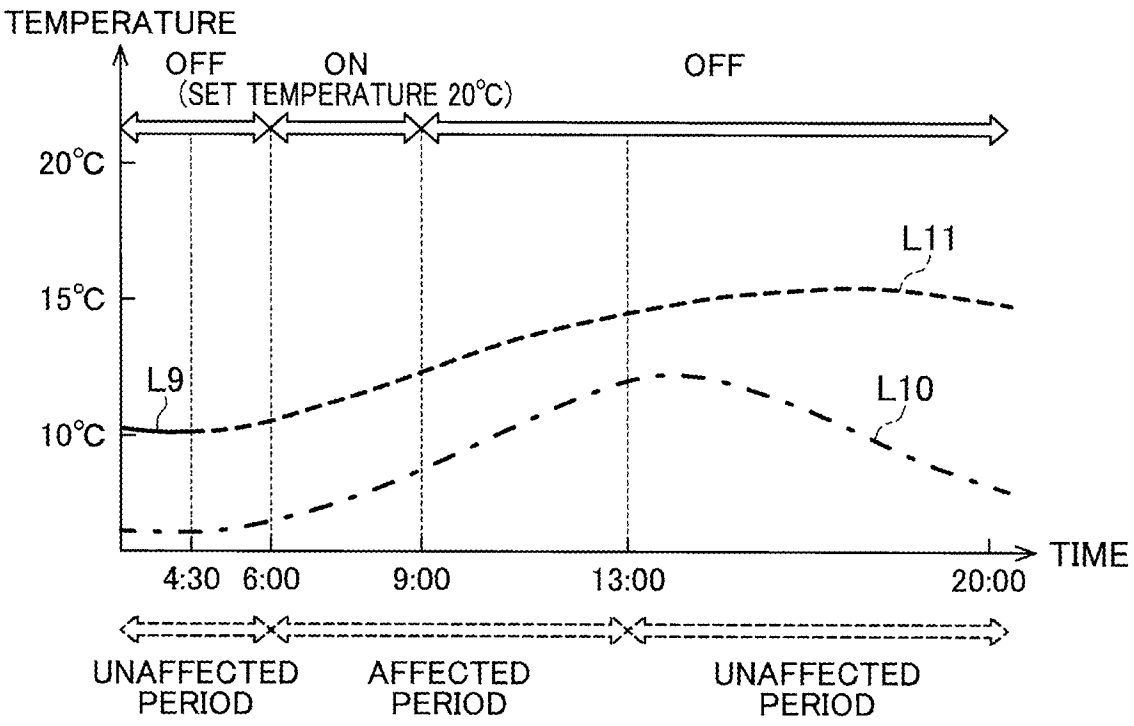
FIG. 10 is a graph illustrating an example of the results of effect determination.

The dotted arrows in FIG. 10 indicate an example of the result of effect determination.

The period during which the temperature control device is turned on, that is, from 6:00 a.m. to 9:00 a.m., is an affected period.

A predetermined period from the start of the off-state of the temperature control device is also an affected period, and, in this example, the predetermined period is four hours from the start of the off-state. Thus, the affected period is from 9:00 a.m. to 1:00 p.m.

The unaffected periods are periods other than the affected period, and in this example, are the periods between 0:00 a.m. and 6:00 a.m. and between 1:00 p.m. and 12:00 p.m.

Referring back to FIG. 8, the unaffected-room-temperature estimating unit 111 then estimates the room temperature by using the room temperature model stored in the room-temperature-model storage unit 110 (step S21). The estimated room temperature is also referred to as a first estimated room temperature.

The dashed line L11 in FIG. 10 indicates an example of the estimated result of the room temperature.

In this example, the room temperature after 4:30 a.m. is estimated by using the room temperature until 4:30 a.m. and the forecast atmospheric temperature. Since the room temperature model has learned the room temperature in the unaffected periods, the estimated result indicates the room temperature for when the temperature control device is remains turned off.

The input of the room temperature model used may be only the atmospheric temperature or only the room temperature. For example, when the input is only the room temperature, the estimation accuracy deteriorates as time passes from the time when the input room temperature is obtained, but it is possible to perform the estimation process by the indoor-temperature estimation apparatus 100 without the acquisition of the external environment information.

The integrating unit 115 then determines whether or not an affected period is included in the room temperature estimation target period, which is a target period for the estimation of room temperature (step S22). If the room temperature estimation target period includes an affected period (Yes in step S22), the process proceeds to step S23, and if the room temperature estimation target period does not include an affected period (No in step S22), the process proceeds to step S25.

In step S23, the affected-room-temperature estimating unit 114 uses the room temperature change model stored in the room-temperature-change-model storage unit 113 to estimate the room temperature change in the affected period from the room temperature history information, the temperature control information, and the unaffected room temperature, and thereby estimates the room temperature in the affected period. The estimated room temperature is also referred to as a second estimated room temperature.

In the example illustrated in FIG. 10, the temperature difference at the start of the on-state can be estimated from the set temperature and the unaffected room temperature at the start of the on-state at 6:00 a.m., and this temperature difference can be input to the post-on-state room temperature change model to estimate the room temperature change in the on-state period.

The difference between the room temperature at the start of the off-state at 9:00 a.m. in the estimated result of the room temperature change in the on-state period and the unaffected room temperature at that time is defined as the temperature difference, and this temperature difference can be input to the post-off-state room temperature change model to estimate the room temperature change in the off-state period.

The integrating unit 115 then integrates the estimated result of the room temperature given from the unaffected-room-temperature estimating unit 111 and the estimated result of the room temperature change given from the affected-room-temperature estimating unit 114, to generate an integrated room temperature estimated result, which is the final estimated result of the room temperature (step S24). In this example, the integrating unit 115 connects the room temperature in the unaffected period estimated by the unaffected-room-temperature estimating unit 111 and the room temperature in the affected periods estimated by the affected-room-temperature estimating unit 114, to generate the integrated room temperature estimated result.

Figure 11:
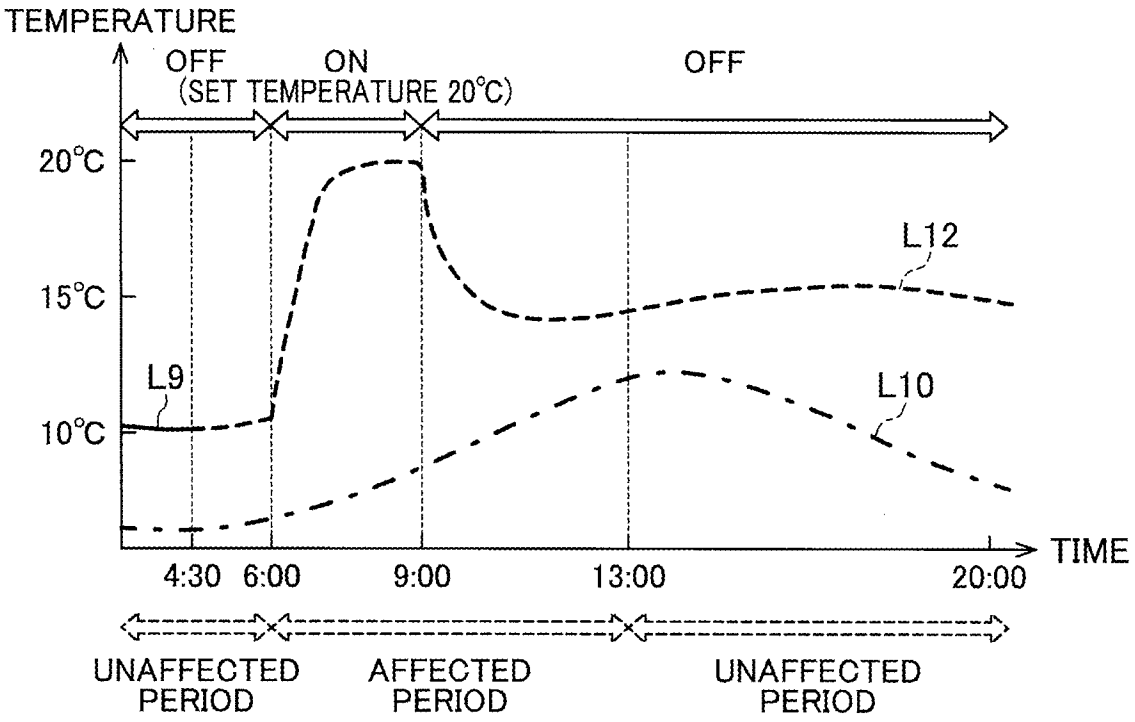
FIG. 11 is a graph illustrating an example of room temperatures indicated in an integrated room temperature estimated result.

The dashed line L12 in FIG. 11 indicates an example of the room temperature indicated by the integrated room temperature estimated result.

In step S25, the output unit 116 outputs the integrated room temperature estimated result. If it is determined in step 522 that the room temperature estimation target period does not include an affected period (No in step S22), the integrating unit 115 gives the result of the room temperature estimated in step S21 to the output unit 116 as the integrated room temperature estimated result.

The output integrated room temperature estimated result is used as follows.

For example, the temperature control device is an air conditioner, and the room is the living room of the user's residence. The indoor-temperature estimation apparatus 100 predicts the future room temperature of when the air conditioner is turned off, and if the predicted room temperature is high, and there is a risk of the user suffering heatstroke, or if the predicted change in the room temperature is large, and there is a risk of the user having unstable blood pressure, the user is notified of the estimated room temperature, or the air conditioner is controlled to prevent the user from experiencing a health hazard.

The indoor-temperature estimation apparatus 100 predicts, for example, the room temperature after the air conditioner is turned on, notifies the user of the room temperature at the time the user is scheduled to return home, and prompts the user to set the operation of the air conditioner so that the room becomes comfortable when the user returns home.

Moreover, the indoor-temperature estimation apparatus 100 predicts, for example, the room temperature after the air conditioner is turned off, and notifies the user that comfort can be maintained even if the air conditioner is turned off slightly before the user leaves home for work, to promote energy saving.

According to the above-described embodiments, the indoor-temperature estimation apparatus 100 can simplify the learned model by defining different cases depending on the presence or absence of the effect of the temperature control device and using the room temperature model for an unaffected period and a room temperature change model for an affected period. For example, the room temperature model for the unaffected period can simplify the model by removing the effect of the temperature control device, and the room temperature change model for the affected period can simplify the model by transferring the effect of the external environment to the room temperature model.

As indicated in the Akaike information criterion and the like, the more complex the model, the more likely overfitting is to occur, and more learning data is required to improve accuracy. According to the present embodiment, the model is simplified to reduce the number of data items required to satisfy the estimation accuracy required for learning the model, and thus the start of service provision can be accelerated by using the estimated room temperature. The volume of data to be processed or stored when the model is used can be reduced to reduce the computational load.

Although the embodiments have been described above, the disclosure is not limited to these embodiments. The present embodiment describes an example of the learning process and the estimation process of when the temperature control device heats the room, but the learning process and the estimation process can be performed in a similar manner as when the temperature control device cools the room.

DESCRIPTION OF REFERENCE CHARACTERS

100 indoor-temperature estimation apparatus; 101 I/F unit; 102 room-temperature-information acquiring unit; 103 room-temperature-history-information storage unit; 104 temperature-control-information acquiring unit; 105 temperature-control-information storage unit; 106 external-environment-information acquiring unit; 107 external-environment-information storage unit; 108 effect determining unit; 109 room-temperature-model generating unit; 110 room-temperature-model storage unit; 111 unaffected-room-temperature estimating unit; 112 room-temperature-change-model generating unit; 113 room-temperature-change-model storage unit; 114 affected-room-temperature estimating unit; 115 integrating unit; 116 output unit; 117 model acquiring unit.

What is claimed is:

1. An indoor-temperature estimation apparatus comprising:

a processor to execute a program; and a memory to store the program which, when executed by the processor, performs processes of, specifying a learning affected period and a learning unaffected period from operation history information indicating an operation history of a temperature control device controlling room temperature in a learning period, the room temperature being indoor temperature, the learning period being a period during which learning of the room temperature is performed, the learning affected period being a period during which the room temperature is affected by the temperature control device in the learning period, the learning unaffected period being a period during which the room temperature is unaffected by the temperature control device in the learning period;

generating a room temperature model in the learning unaffected period from room temperature history information, by learning external environment information and by learning room temperature in the learning unaffected period, the room temperature history information indicating a history of learning room temperature, and the external environment information indicating an outdoor environment;

estimating a learning temporary room temperature by using the room temperature model, the learning temporary room temperature being the room temperature estimated without an effect of the temperature control device in a same period as the learning affected period; and generating a room temperature change model, in the learning affected period, by using the room temperature history information and the operation history information and by learning the learning room temperature and the learning temporary room temperature in the learning affected period, the room temperature change model indicating a change in the room temperature caused by the temperature control device.

2. The indoor-temperature estimation apparatus according to claim 1, wherein, the learning affected period is a period during which the temperature control device is turned on and a predetermined period after the temperature control device is turned off, and the learning unaffected period is a period other than the learning affected period.

3. The indoor-temperature estimation apparatus according to claim 2, wherein the processor generates, as the room-temperature-change model:

an on-state room temperature change model that is generated by learning a temperature difference between the learning temporary room temperature at a time the temperature control device is turned on and a set temperature of the temperature control device, and the learning room temperature in time-series after the temperature control device is turned on, to indicate a change in the room temperature from a time the temperature control device is turned on to a time the temperature control device is turned off; and an off-state room temperature change model that is generated by learning a temperature difference between the learning temporary room temperature at a time the temperature control device is turned off and the learning room temperature at the time the temperature control device is turned off, and the learning room temperature in time-series after the temperature control device is turned off, to indicate a change in the room temperature from a time the temperature control device is turned off until the predetermined period passes.

4. The indoor-temperature estimation apparatus according to claim 1, wherein the processor refers to operation plan information to specify a target affected period and a target unaffected period, the operation plan information indicating an operation plan of the temperature control device in a target period during which the room temperature is estimated, the target affected period being a period during which the room temperature is affected by the temperature control device in the target period, the target unaffected period being a period during which the room temperature is not affected by the temperature control device in the target period, the processor refers to target external environment information to estimate a first estimated room temperature from a target state by using the room temperature model, the target external environment information indicating the target state, the target state being an outdoor state during the target period, the first estimated room temperature being the room temperature in the target period, the processor uses the room temperature change model to estimate a change in the room temperature in the target affected period and to use the change in the room temperature to estimate a second estimated room temperature, the second estimated room temperature being an affected room temperature that is a room temperature in the target affected period; and the processor integrates the first estimated room temperature and the second estimated room temperature to generate an estimated result of the room temperature in the target period.

5. The indoor-temperature estimation apparatus according to claim 4, wherein, the target affected period is a period during which the temperature control device is turned on and a predetermined period after the temperature control device is turned off, and the target unaffected period is a period other than the target affected period.

6. The indoor-temperature estimation apparatus according to claim 1, wherein the temperature control device is an air conditioner that conditions indoor air.

7. An indoor-temperature estimation apparatus comprising:

a processor to execute a program; and a memory to store the program which, when executed by the processor, performs processes of, referring to operation plan information and specifying a target affected period and a target unaffected period, the operation plan information indicating an operation plan of a temperature control device controlling room temperature during a target period during which room temperature is estimated, the room temperature being indoor temperature, the target affected period being a period during which the room temperature is affected by the temperature control device in the target period, the target unaffected period being a period during which the room temperature is not affected by the temperature control device in the target period;

referring to target external environment information indicating a target state to estimate a first estimated room temperature from the target state by using a room temperature model, the target state being a state of an outdoor during the target period, the first estimated room temperature being the room temperature in the target period, the room temperature model indicating a relationship between the state and the room temperature;

referring to a room temperature change model to estimate a change in the room temperature caused by the temperature control device, and uses the estimated change in the room temperature to estimate a second estimated room temperature, the second estimated room temperature being the room temperature in the target affected period;

integrating the first estimated room temperature and the second estimated room temperature to generate an estimated result of the room temperature in the target period; and controlling the temperature control device to adjust the room temperature during the target period based on the estimated result.

8. The indoor-temperature estimation apparatus according to claim 7, wherein, the target affected period is a period during which the temperature control device is turned on and a predetermined period after the temperature control device is turned off, and the target unaffected period is a period other than the target affected period.

9. The indoor-temperature estimation apparatus according to claim 7, wherein the processor specifies a learning affected period and a learning unaffected period from operation history information indicating an operation history of the temperature control device in a learning period during which learning is performed, the learning affected period being a period during which the room temperature is affected by the temperature control device in the learning period, the learning unaffected period being a period during which the room temperature is unaffected by the temperature control device in the learning period;

the processor generates a room temperature model in the learning unaffected period from room temperature history information, by learning external environment information and by learning room temperature in the learning unaffected period, the room temperature history information indicating a history of learning room temperature, and the external environment information indicating an outdoor environment refers to room temperature history information indicating a history of learning room temperature and learning external environment information indicating environment a learning state and learns the learning state and the learning room temperature in the learning unaffected period, to generate the room temperature model, the learning room temperature being the room temperature in the learning period, the learning state being the state during the learning period, the processor refers to the learning external environment information and estimates a learning temporary room temperature by using the room temperature model, the learning temporary room temperature being the room temperature estimated without an effect of the temperature control device in a same period as the learning affected period, and the processor generates a room temperature change model, in the learning affected period, by using refers to the room temperature history information and the operation history information and by learning the learn the learning room temperature and the learning temporary room temperature in the learning affected period, the to generate a room temperature change model indicating a change in the room temperature caused by the temperature control device.

10. The indoor-temperature estimation apparatus according to claim 9, wherein, the learning affected period is a period during which the temperature control device is turned on and a predetermined period after the temperature control device is turned off, and the learning unaffected period is a period other than the learning affected period.

11. The indoor-temperature estimation apparatus according to claim 10, wherein, the processor generates, as the room-temperature-change model:

an on-state room temperature change model that is generated by learning a temperature difference between the learning temporary room temperature at the time the temperature control device is turned on and a set temperature of the temperature control device, and the learning room temperature in time-series after the temperature control device is turned on, to indicate a change in the room temperature from the time the temperature control device is turned on to the time the temperature control device is turned off; and an off-state room temperature change model that is generated by learning a temperature difference between the learning temporary room temperature at a time the temperature control device is turned off and the learning room temperature at the time the temperature control device is turned off, and the learning room temperature in time-series after the temperature control device is turned off, to indicate a change in the room temperature from a time the temperature control device is turned off until the predetermined period passes.

12. The indoor-temperature estimation apparatus according to claim 7, wherein the temperature control device is an air conditioner that conditions indoor air.

13. A non-transitory computer-readable medium that stores therein a program that causes a computer to execute processes of:

specifying a learning affected period and a learning unaffected period from operation history information indicating an operation history of a temperature control device controlling room temperature in a learning period, the room temperature being indoor temperature, the learning period being a period during which learning of the room temperature is performed, the learning affected period being a period during which the room temperature is affected by the temperature control device in the learning period, the learning unaffected period being a period during which the room temperature is unaffected by the temperature control device in the learning period;

generating a room temperature model in the learning unaffected period from room temperature history information by learning external environment information and by learning room temperature in the learning unaffected period, the room temperature history information indicating a history of learning room temperature, and the external environment information indicating an outdoor environment;

estimating a learning temporary room temperature by using the room temperature model, the learning temporary room temperature being the room temperature estimated without an effect of the temperature control device in a same period as the learning affected period;

generating a room temperature change model, in the learning affected period, by using the room temperature history information and the operation history information and by learning the learning room temperature and the learning temporary room temperature in the learning affected period, the room temperature change model indicating a change in the room temperature caused by the temperature control device; and controlling the temperature control device to adjust the room temperature during a target period based on the room temperature change model.

14. A non-transitory computer-readable medium that stores therein a program that causes a computer to execute processes of:

referring to operation plan information and specify a target affected period and a target unaffected period, the operation plan information indicating an operation plan of a temperature control device controlling room temperature during a target period during which room temperature is estimated, the room temperature being indoor temperature, the target affected period being a period during which the room temperature is affected by the temperature control device in the target period, the target unaffected period being a period during which the room temperature is not affected by the temperature control device in the target period;

estimating a first estimated room temperature from a target state by using target external environment information and a room temperature model, the target state being an outdoor state during the target period, the first estimated room temperature being the room temperature in the target period, the room temperature model indicating a relationship between the target state and the room temperature;

estimating, using a room temperature change model, a change in the room temperature in the target affected period, the room temperature change model indicating a change in the room temperature caused by the temperature control device, and using the change in the room temperature to estimate a second estimated room temperature, the second estimated room temperature being an affected room temperature that is a room temperature in the target affected period;

integrating the first estimated room temperature and the second estimated room temperature to generate an estimated result of the room temperature in the target period; and controlling the temperature control device to adjust the room temperature during the target period based on the estimated result.

15. An indoor-temperature estimation method comprising:

specifying a learning affected period and a learning unaffected period from operation history information indicating an operation history of a temperature control device controlling room temperature in a learning period during which learning is performed, the room temperature being indoor temperature, the learning affected period being a period during which the room temperature is affected by the temperature control device in the learning period, the learning unaffected period being a period during which the room temperature is unaffected by the temperature control device in the learning period;

generating a room temperature model in the learning unaffected period from room temperature history information, by learning external environment information and by learning room temperature in the learning unaffected period, the room temperature history information indicating a history of learning room temperature, and the external environment information indicating an outdoor environment;

estimating a learning temporary room temperature by using the room temperature model, the learning temporary room temperature being the room temperature estimated without an effect of the temperature control device in a same period as the learning affected period;

generating a room temperature change model, in the learning affected period, by using the room temperature history information and the operation history information and by learning the learning room temperature and the learning temporary room temperature in the learning affected period, the room temperature change model indicating a change in the room temperature caused by the temperature control device; and controlling the temperature control device to adjust the room temperature during a target period based on the room temperature change model.

16. An indoor-temperature estimation method comprising:

referring to operation plan information indicating an operation plan of a temperature control device controlling room temperature in a target period during which the room temperature is estimated, to specify a target affected period and a target unaffected period, the room temperature being indoor temperature, the target affected period being a period during which the room temperature is affected by the temperature control device in the target period, the target unaffected period being a period during which the room temperature is not affected by the temperature control device in the target period;

estimating a first estimated room temperature from a target state by using target external environment information and a room temperature model, the target state being an outdoor state in the target period, the first estimated room temperature being the room temperature in the target period, the room temperature model indicating a relationship between the state and the room temperature;

estimating, using a room temperature change model, a change in the room temperature in the target affected period the room temperature change model indicating a change in the room temperature caused by the temperature control device, and using the change in the room temperature to estimate a second estimated room temperature, the second estimated room temperature being an affected room temperature that is a room temperature in the target affected period;

integrating the first estimated room temperature and the second estimated room temperature to generate an estimated result of the room temperature in the target period; and controlling the temperature control device to adjust the room temperature during the target period based on the room temperature change model.

* * * * *